US006124840A

United States Patent [19]

Kwon

[11] Patent Number: 6,124,840

[45] Date of Patent: Sep. 26, 2000

[54] LOW POWER GATE DRIVER CIRCUIT FOR THIN FILM TRANSISTOR-LIQUID CRYSTAL DISPLAY (TFT-LCD) USING ELECTRIC CHARGE RECYCLING TECHNIQUE

[75] Inventor: Oh-Kyong Kwon, Seoul, Rep. of Korea

[73] Assignee: Hyundai Electronics Industries Co., Ltd., Ichon, Rep. of Korea

[21] Appl. No.: 09/082,058

[22] Filed: May 21, 1998

Related U.S. Application Data

[63] Continuation-in-part of application No. 09/039,481, Mar. 16, 1998.

[30] Foreign Application Priority Data

Apr. 7, 1997 [KR] Rep. of Korea ..... 97-12729
May 31, 1997 [KR] Rep. of Korea ..... 97-22565

[51] Int. Cl.[7] ..... G09G 3/36

[52] U.S. Cl. ..... 345/100

[58] Field of Search ..... 345/55, 87, 90, 345/92, 98, 100, 196–198, 513, 96, 79, 93, 211; 340/719

[56] References Cited

U.S. PATENT DOCUMENTS 4,804,951 2/1989 Yamashita et al. ..... 345/92
4,870,399 9/1989 Carlson ..... 345/55
5,465,054 11/1995 Erhart ..... 326/34
5,510,748 4/1996 Erhart et al. ..... 327/530
5,528,256 6/1996 Erhart et al. ..... 345/96
5,572,211 11/1996 Erhart et al. ..... 341/144
5,578,957 11/1996 Erhart et al. ..... 327/333
5,604,449 2/1997 Erhart et al. ..... 326/81
5,682,175 10/1997 Kitamura ..... 345/98
5,748,165 5/1998 Kubota et al. ..... 345/96
5,838,289 11/1998 Saito et al. ..... 345/79
5,907,314 5/1999 Negishi et al. ..... 345/103

FOREIGN PATENT DOCUMENTS 0 488 516A 6/1992 European Pat. Off. .
4-355789 12/1992 Japan .
2188473 9/1987 United Kingdom .

*Primary Examiner*—Vijay Shankar
*Assistant Examiner*—Jeff Piziali
*Attorney, Agent, or Firm*—Fleshner & Kim, LLP

[57] ABSTRACT

A low power gate driver circuit of a thin film transistor-liquid crystal display (TFT-LCD) recycles an electric charge. The electric charge is recycled by discharging the electric charge which is stored in a capacitor of a gate line to a capacitor of another gate line, thereby reducing the consumption of power.

13 Claims, 11 Drawing Sheets

LOW POWER GATE DRIVER CIRCUIT FOR THIN FILM TRANSISTOR-LIQUID CRYSTAL DISPLAY (TFT-LCD) USING ELECTRIC CHARGE RECYCLING TECHNIQUE

This is a continuation-in-part application of U.S. application Ser. No. 09/039,481, filed Mar. 16, 1998, and the disclosure therein is incorporated herein by reference.

BACKGROUND OF THE INVENTION

1. Field of the Invention

The present invention relates to a thin film transistor-liquid crystal display (TFT-LCD), and in particular to an improved low power gate driver circuit of the TFT-LCD using an electric charge recycling technique.

2. Background of the Related Art

As shown in FIG. 1, a conventional TFT-LCD includes a liquid crystal panel 10 having a plurality of pixels 10' which are formed within each intersecting areas of the gate lines GL and the data lines DL. A data driver 20 outputs a picture signal to the liquid crystal panel 10 through the data lines DLn, and a gate driver 30 turns on the pixels 10' by driving the gate lines GLn. Each pixel 10' includes a thin film transistor 1, and a storing capacitor Cs and a liquid crystal capacitor Clc. Each capacitor is connected in parallel with the thin film transistor 1.

During operation, a shift resistor (not shown) of the data driver 20 sequentially receives a picture data by a single pixel, and stores the picture data of the data lines DL. The gate driver 30 outputs a signal having the waveform shown in FIG. 2, thus sequentially driving the plurality of gate lines GLn. Each gate line GL can be modeled as a resistor and a capacitor. A size of the resistor and capacitor varies depending on a screen size and a constituent material of the gate line. Generally, the resistor has a resistance of about few KΩ (kilo ohms), and the capacitor has a capacitance of about few pF (pico farads).

In an office automation (O/A) application such as computer displays, the gate driver 30 outputs a signal having the waveform shown in FIG. 2A, and in an audio/video (A/V) application such as TVs, the gate driver 30 outputs a signal having the waveform shown in FIG. 2B of an even number field, and a signal having the waveform shown in FIG. 2C of an odd number field to drive the gate lines GL.

In a sequential scanning method for the O/A application, the gate driver 30 charges the capacitances (not shown) of the gate lines GLn in accordance with a signal having the same pattern as shown in FIG. 2A, and discharges the electric charge to a ground (or VSS), thereby driving the plurality of gate lines GLn. In an even number field of a double line simultaneous scanning method for the A/V application, as shown in FIG. 2B, the gate driver 30 drives the plurality of gate lines GLn by repetitively applying the same signal to first and second gate lines GL1 and GL2, then applying the same signal to third and fourth gate lines GL3 and GL4. In an odd number field of the double line simultaneous scanning method for the A/V application, as shown in FIG. 2C, the gate driver 30 charges the capacitances (not shown) of the gate line GL by repetitively applying a signal to the first gate line GL1, applying the same signal to the second and third gate lines GL2 and GL3, and applying the same signal to the fourth and fifth gate lines GL1 and GL5, and discharges the electric charge to the ground (or VSS) to drive the gate lines GLn.

As a result, the plurality of thin film transistors connected with the selected gate lines GLn are turned on, and picture data stored in the shift resistors (not shown) of the data driver 20 are applied to the thin film transistors to display the picture on the liquid crystal panel 10. The above-described operation is repeated to display the picture on the liquid crystal panel 10.

Generally, the output signal of the gate driver 30 swings from VDD to VSS (or the ground), or from VSS to VDD. If the gate driver 30 drives an nth gate line GLn, the power $P_1$, which the gate driver 30 consumes, is same as the following formula (1).

$$P_1 = VDD \cdot I_{av} = VDD \cdot (C_n \cdot V_{swing} \cdot \text{Frame frequency}) \quad (1),$$

where

Cn is a the capacitance of capacitor of the nth gate line GLn and $I_{av}$ is an average current, and $V_{swing}$ is a voltage swing of scanning pulse.

Accordingly, in the conventional TFT-LCD driving circuit, the gate driver 30 outputs a signal which swings from VDD to Vss (or the ground), or from VSS to VDD in order to charge/discharge the capacitance of the gate line GL, thereby consuming the power proportional to a value of VDD multiplied by $V_{swing}$ during the charging/discharging process.

SUMMARY OF THE INVENTION

Another object of the present invention is to solve the problems or disadvantages of the background art.

Another object of the present invention is to provide a low power gate driver circuit of for TFT-LCD.

A further object of the present invention is to use an electric charge recycling technique.

A further object of the invention is to use the switching device, positioned between gate lines, and to recycle the electric charge by discharging the electric charge which is charged in a capacitor of a gate line to a capacitor of another gate line.

A further object of the invention is to reduce the consumption of energy by a gate driver.

To achieve the above objects, there is provided a low power gate driver circuit of a TFT-LCD using an electric charge recycling technique, wherein a gate driver controls a supplied picture signal to be transferred to a liquid crystal capacitor and a storing capacitor by controlling a TFT having a pixel of a single line, and a liquid crystal panel displays the transferred picture signal, comprising a first switching unit, positioned next to an output terminal of the gate driver, for having a gate line in a floating state in accordance with a control signal which is inputted during a horizontal blank time of one horizontal cycle, a control signal generator for outputting control signals which are applied to a sequential scanning method and a double line simultaneous scanning method by receiving first and second signals and a source voltage, which are alternatively inputted thereto for two horizontal cycles, and a second switching unit, positioned between each gate line, for recycling an electric charge which is charged in each of the gate lines in accordance with the control signals outputted from the control signal generator during the horizontal blank time.

The present invention may be achieved in whole or in parts by a display device comprising a plurality of first signal lines in a first direction; a plurality of second signal lines in a second direction; a display unit having a plurality of pixels, each pixel coupled to a corresponding first signal line and a corresponding second signal line; a switching device coupled to the plurality of second signal lines; a control signal generator coupled to the switching device; a first driver coupled to the plurality of first signal lines; and a second driver coupled to the switching device, wherein the switching device disconnects the plurality of first second signal lines for a prescribed period of time to allow transfer of charges between corresponding second signal lines Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 3:
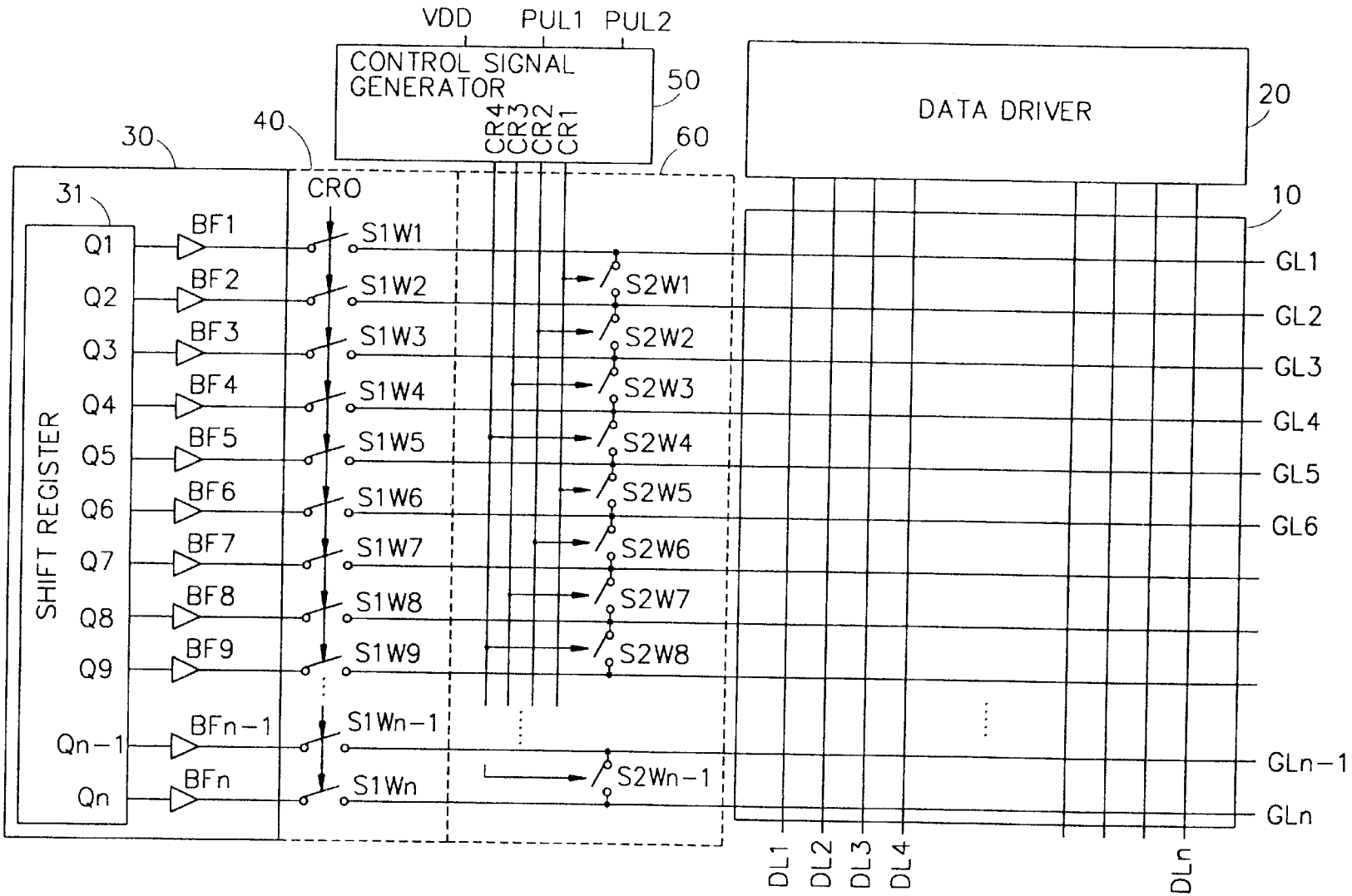
FIG. 3 is a block diagram of a low power gate driver circuit of a TFT-LCD using an electric charge recycling technique according to a preferred embodiment of the present invention.

FIG. 3 illustrates a low power gate driver circuit of the TFT-LCD using an electric charge recycling technique according to a preferred embodiment of the present invention. A first switching unit 40 is positioned between a gate driver 30 and a second switching unit 60 and maintains a plurality of gate lines GLn in a floating state in accordance with a control signal CR0 during a horizontal blank time. A control signal generator 50 receives a source voltage VDD and pulse signals PUL1 and PUL2, and outputs a plurality of control signals CR1, . . . ,CRy, where y is 4 regardless of the number of the gate lines GLn or y is n−1 in case that the control signals are directly applied to the second switching unit 60 and the control signal generator is not used. The second switching unit 60 recycles an electric charge which is charged in the gate lines GLn in accordance with the control signals CR1, . . . CRy.

The gate driver includes a shift register 31 and a plurality of buffers BF1–BFn coupled to a plurality of output terminals Q1–Qn of the shift register. The first switching unit 40 comprises a plurality of first switches S1N1–S1Wn responsive to the control signal CRO. The second switching unit 60 is positioned between the first switching unit 40 and a liquid crystal panel 10, and includes with a plurality of second switches S2W1–S2Wn−1, which connect the gate lines GLn with each other in accordance with the control signals CR1, . . . ,CRy outputted from the control signal generator 50. Here, the first and second switches can be substituted for a plurality of transmitting gates or pass-transistors. Further, each of the buffers BF1–BFn in the gate driver 30, and a corresponding first switch of the first switching unit 40 can be substituted with a tri-state buffer. As can be appreciated, other variations are possible.

Figure 4:
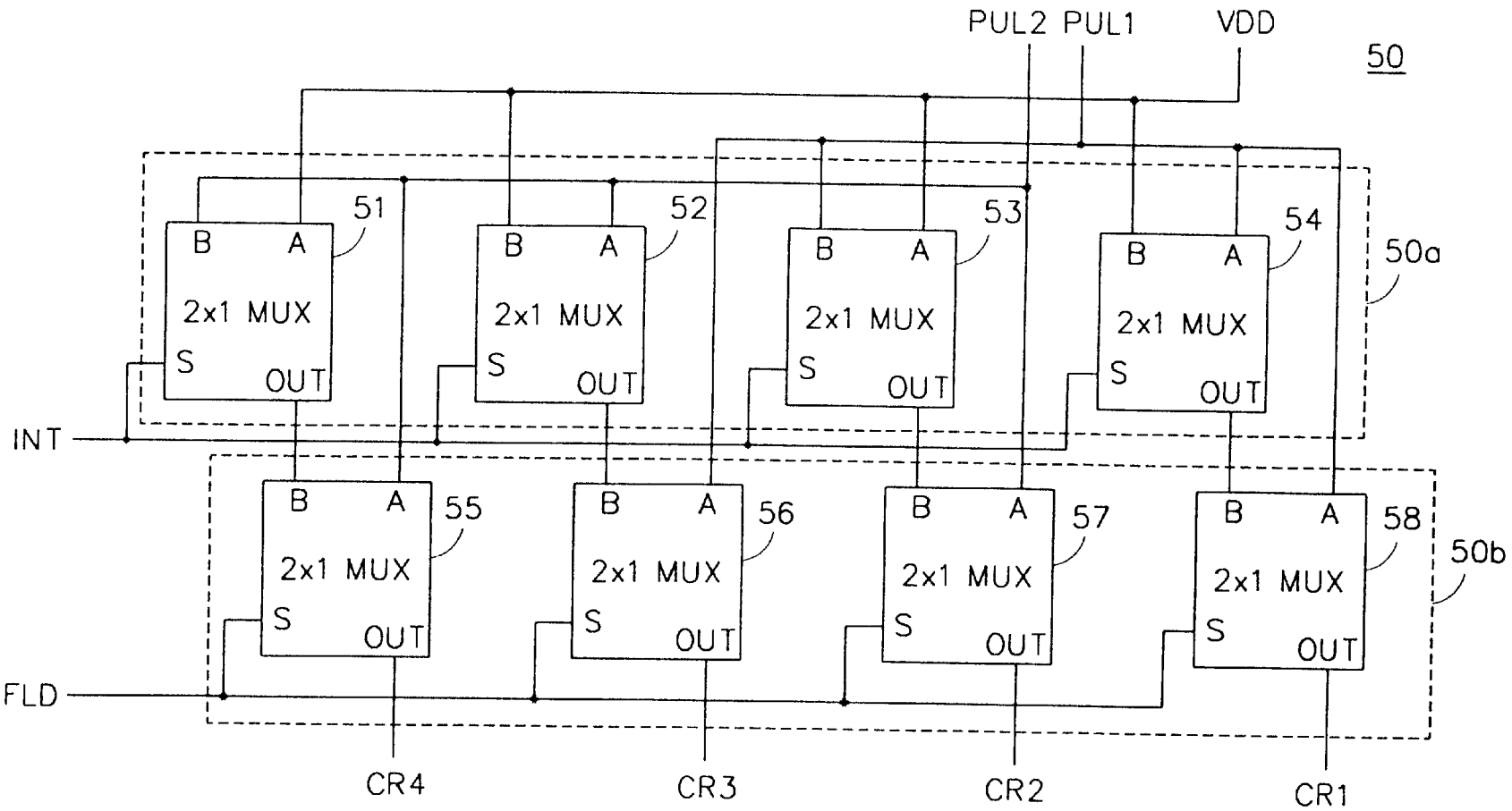
FIG. 4 is a detail circuit diagram of a control signal generator of FIG. 3.

As shown in FIG. 4, the control signal generator 50 includes a first control unit 50*a* having a plurality of multiplexers 51–54 and a second control unit 50*b* having a plurality of multiplexers 55–58. The multiplexers 51 and 52 selectively output a pulse signal PUL2 or a source voltage VDD in accordance with a first input control signal INT, and the multiplexers 53 and 54 selectively output a pulse signal PUL1 or the source voltage VDD in accordance with the first input control signal INT. The multiplexer 55 outputs one of an output signal from the multiplexer 51 and the pulse signal PUL2 as a control signal CR4 in accordance with a second input control signal FLD. The multiplexer 56 outputs one of an output signal from the multiplexer 52 and the pulse signal PUL1 as a control signal CR3 in accordance with the second input control signal FLD. The multiplexer 57 outputs one of an output signal from the multiplexer 53 and the pulse signal PUL2 as a control signal CR2 in accordance with the second input control signal FLD, and the multiplexer 58 outputs one of an output signal from the multiplexer 54 and the pulse signal PUL1 as a control signal CR1 in accordance with the second input control signal FLD.

The operation of the above-described low power gate driver circuit of the TFT-LCD using the electric charge recycling technique according to the present invention will now be described. A blank time exists between frames when the picture signal is externally inputted thereto, and between the gate lines GL when the picture signal is not inputted thereto. The blank time between the gate lines GLn is a horizontal blank time, and between the frames is a vertical blank time. Generally, the horizontal blank time is 5.72 $\mu$sec., and the vertical blank time is approximately 10 $\mu$sec.

In order to support the sequential scanning method for the O/A application and the double line simultaneous scanning method the A/V application, the low power gate driver circuit of the TFT-LCD using the electric charge recycling technique according to the present invention outputs the control signals CR1, . . . ,CRy, each having a prescribed pulse width for a prescribed period of the horizontal blank time, to the second switching unit 60 by using the control signal generator 50, thereby recycling the electric charge which is stored in each of the gate lines GLn by turning on the switches S2W1, . . . ,S2Wn−1 of the second switching unit 60. The low power gate driver according to a preferred embodiment of the present invention may reduce the number of input pins by using the control signal generator 50 shown in FIG. 4, without receiving all the control signals CR1, . . . ,CRy.

Figure 10:
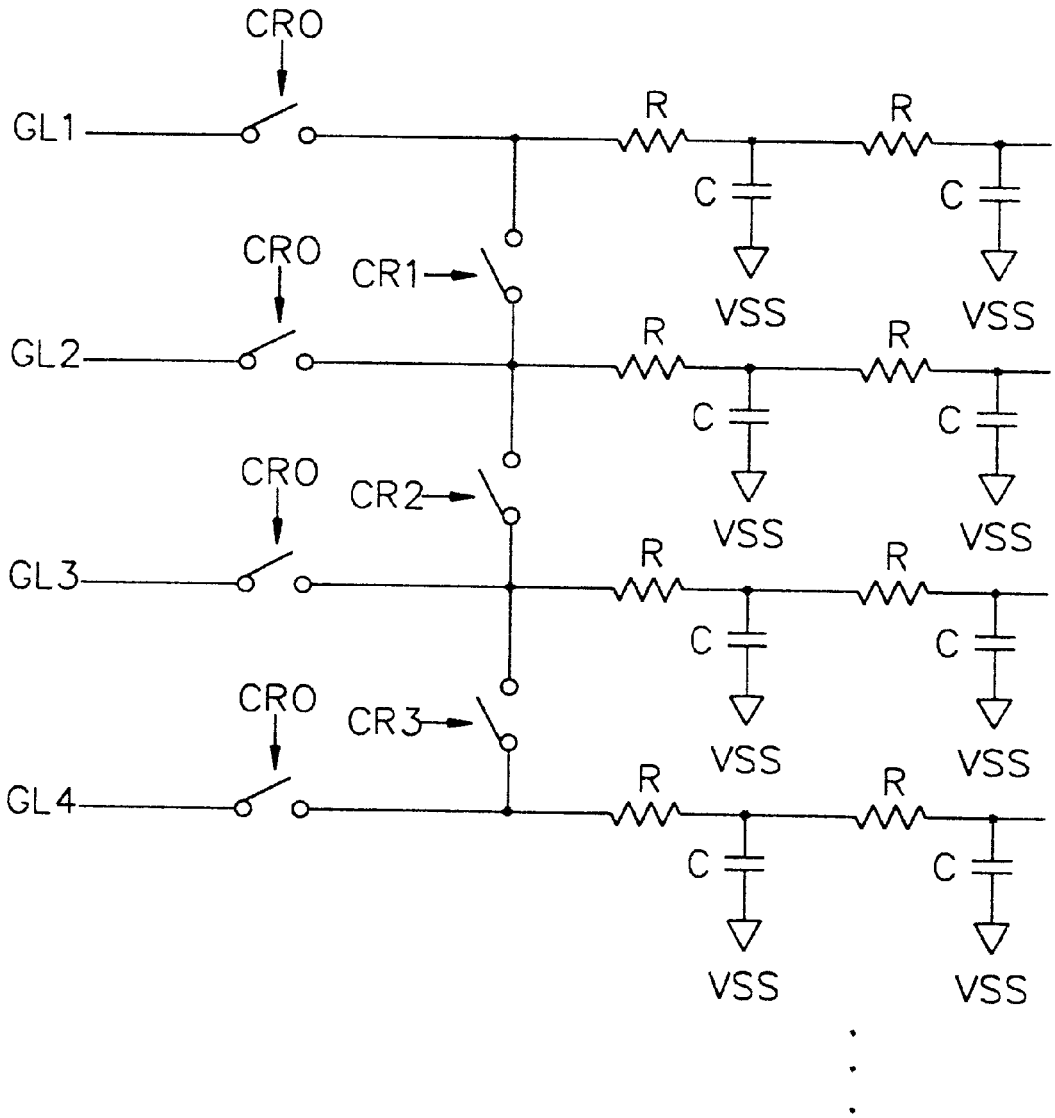
FIG. 10 is a diagram illustrating a circuit of each gate line, and first and second switching units.

First, a data driver 20 sequentially receives a picture signal of each pixel, and outputs a picture signal which corresponds to each of the plurality of data lines DLn, and the gate driver 30 outputs a gate line selection signal, thereby sequentially selecting each of the plurality of gate lines GLn. Here, as shown in FIG. 10, the gate lines GLn can be modeled as a resistor R and a capacitor C, wherein the resistance normally ranges from about 3.5 KΩ to 6.5 KΩ, and the capacitance is about 100 pf.

Figure 5A:
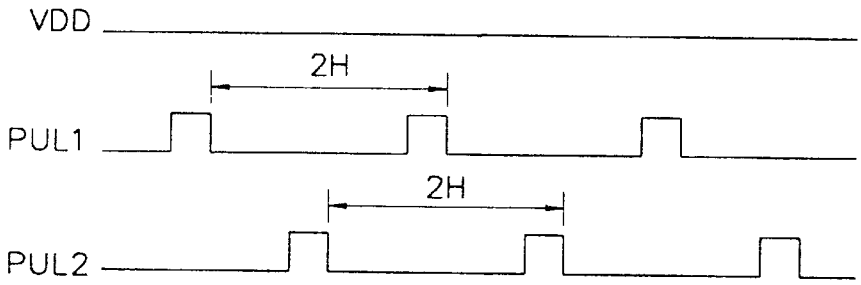
FIGS. 5A–5D are waveform diagrams of input/output signals of a control signal generator in FIG. 4.
Figure 5B:
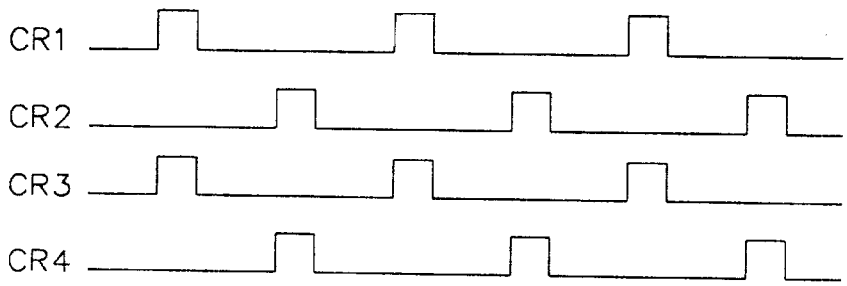
Figure 5C:
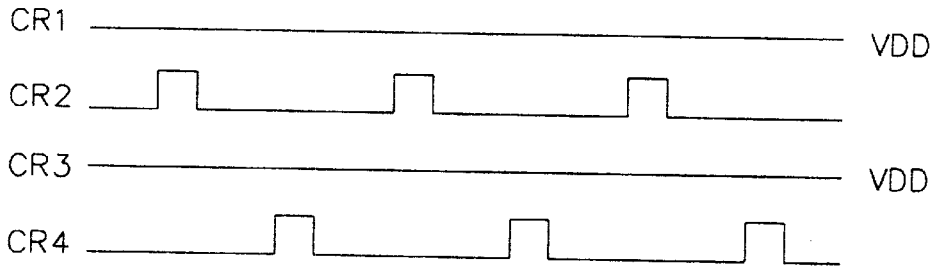
Figure 5D:
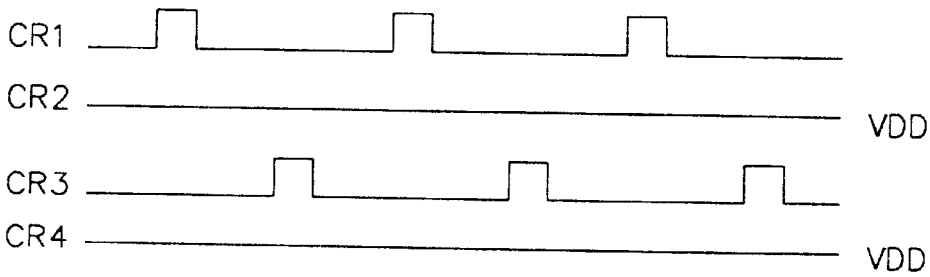

In addition, the control signal generator 50 receives an external source voltage VDD and pulse signals PUL1 and PUL2 shown in FIG. 5A. When the first input control signal INT is 1, the control signal generator 50 generates the control signals CR1–CR4, as shown in FIG. 5B, for the sequential scanning method applied to O/A, regardless of a value of the second input control signal FLD. When the first input control signal INT is 0 and the second input control signal FLD is 0, the control signal generator 50 generates the control signals CR1–CR4 for an even number field of the double line simultaneous scanning method applied to A/V application shown in FIG. 5C. When the first input control signal INT is 0 and the second input control signal FLD is 1, the control signal generator 50 generates the control signals CR1–CR4 for an odd number field of the double line simultaneous scanning method applied to A/V application shown in FIG. 5D.

The first input control signal INT determines whether the liquid crystal panel 10 is used for A/V application or for O/A application. When the first input control signal INT is 1, it indicates that the liquid crystal panel 10 is used for the O/A application. When the first input control signal INT is 0, the panel 10 is used for the A/V application.

The second input control signal FLD is a field signal. When the second input control signal FLD is 0, it indicates the even number field of the double line simultaneous scanning method. When the second input control signal FLD is 1, it indicates the odd number field.

The operation for generating the control signal for the sequential scanning method for the O/A application will be described. First, if the plurality of switches S1W1–S1Wn of the first switching unit 40 are turned on in accordance with a control signal CR0 at a high level shown in FIG. 6A, the gate driver 30 outputs a signal at a VDD level through a buffer BF1 of the last output terminal, thus driving (charging) a capacitor C of a first gate line GL1.

Figures 6A, 6B, 6C, 6D, 6E, 6F, 6G, 6H, 6I:
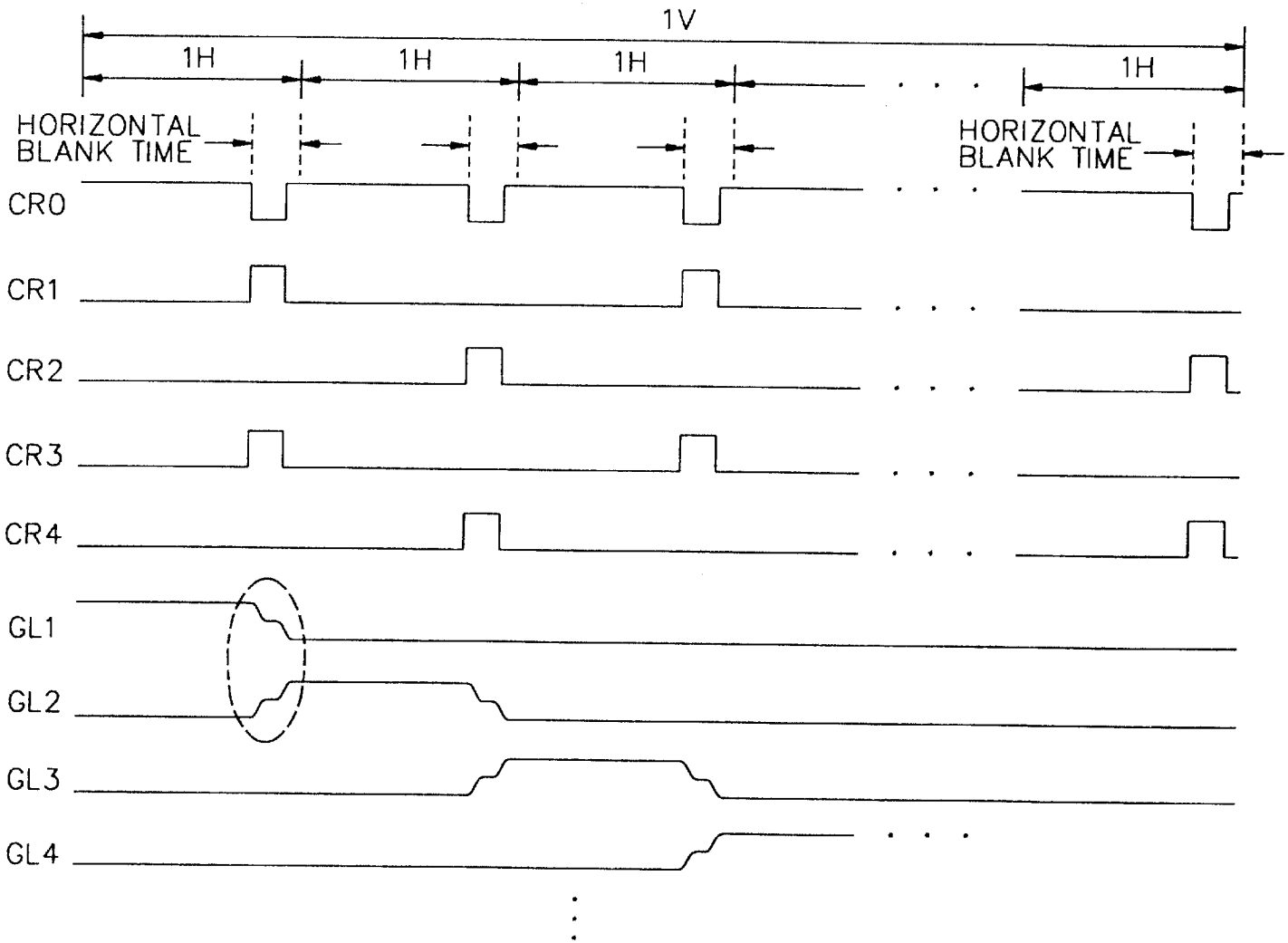
FIGS. 6A–6I are waveform diagrams of output signals of gate drivers for an output of a control signal generator and an electric charge recycling in a sequential scanning method for an O/A application.
Figure 7:
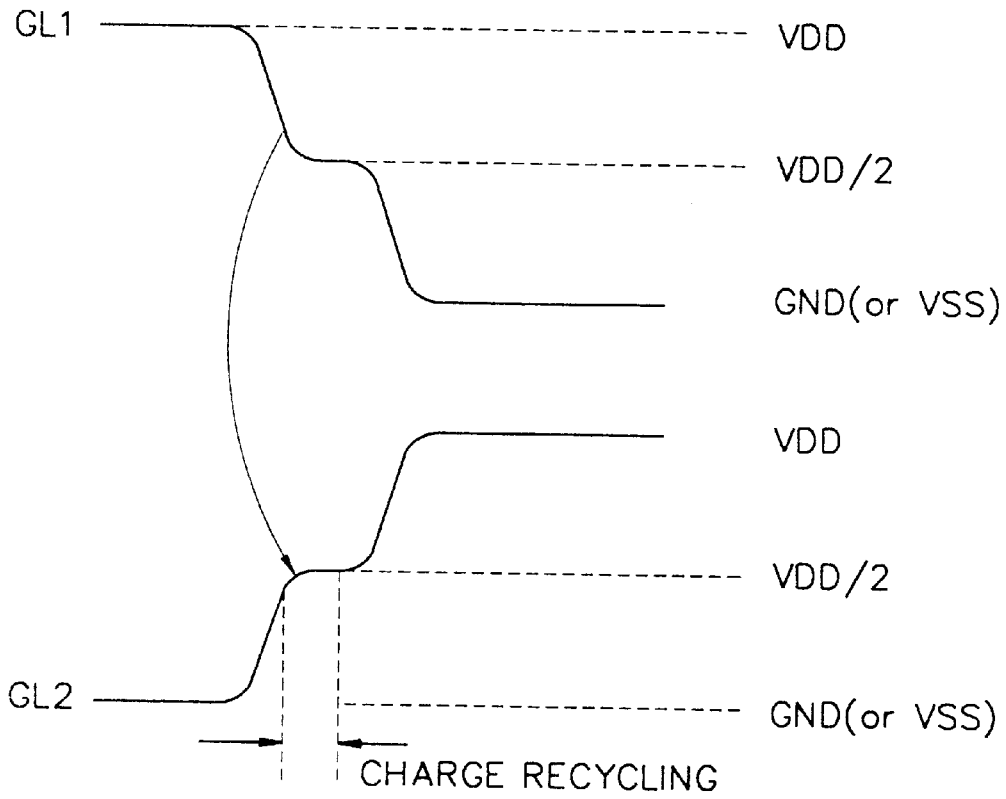
FIG. 7 is an enlarged diagram illustrating an electric recycling technique of FIGS. 6F and 6G.
Figures 8A, 8B, 8C, 8D, 8E, 8F, 8G, 8H, 8I, 8J, 8K:
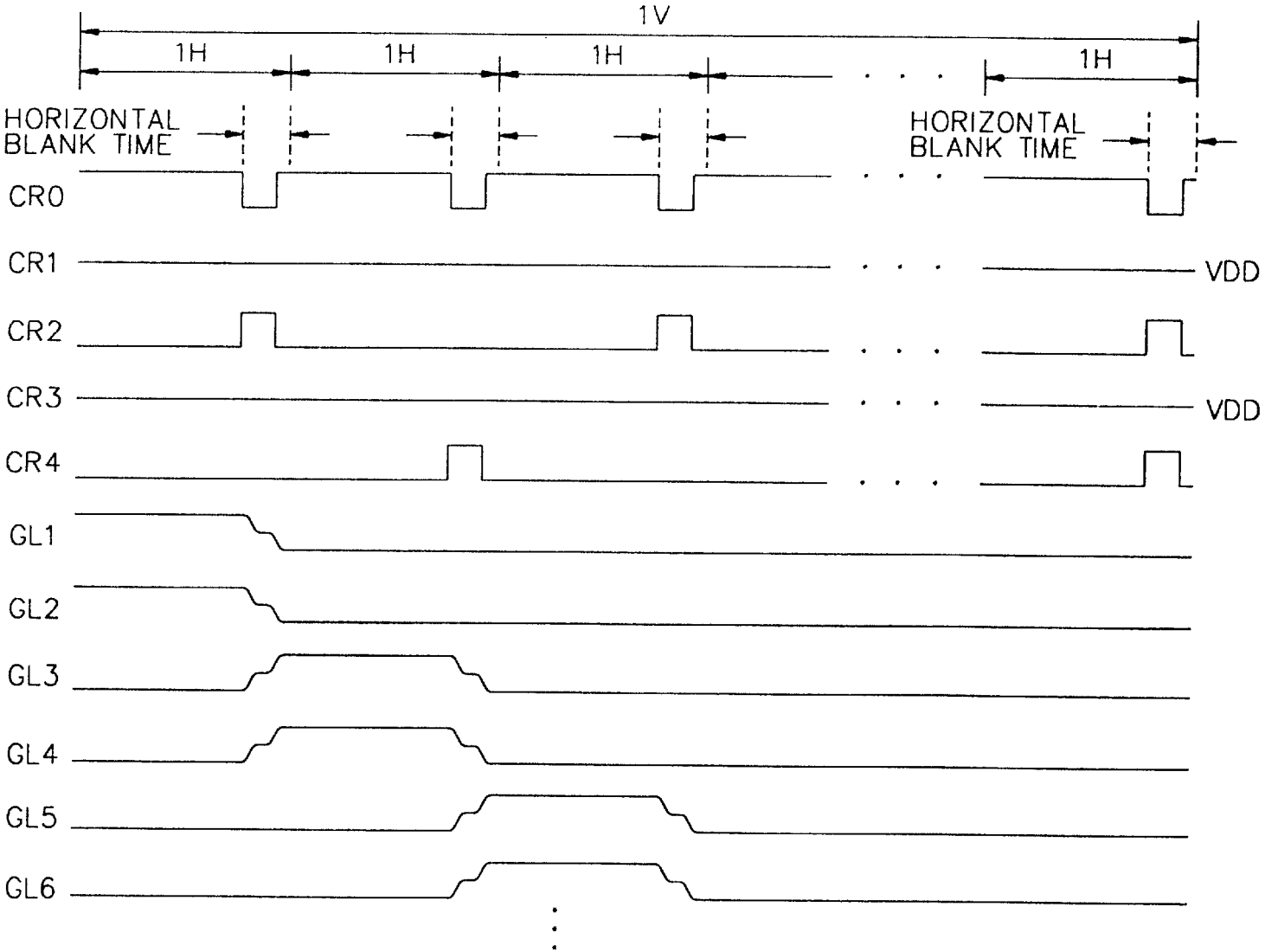
FIGS. 8A–8K are waveform diagrams of gate drivers for outputs of a control signal generator and an electric charge recycling, in an even number field of a double line simultaneous scanning method for an A/V application.
Figures 9A, 9B, 9C, 9D, 9E, 9F, 9G, 9H, 9I, 9J, 9K:
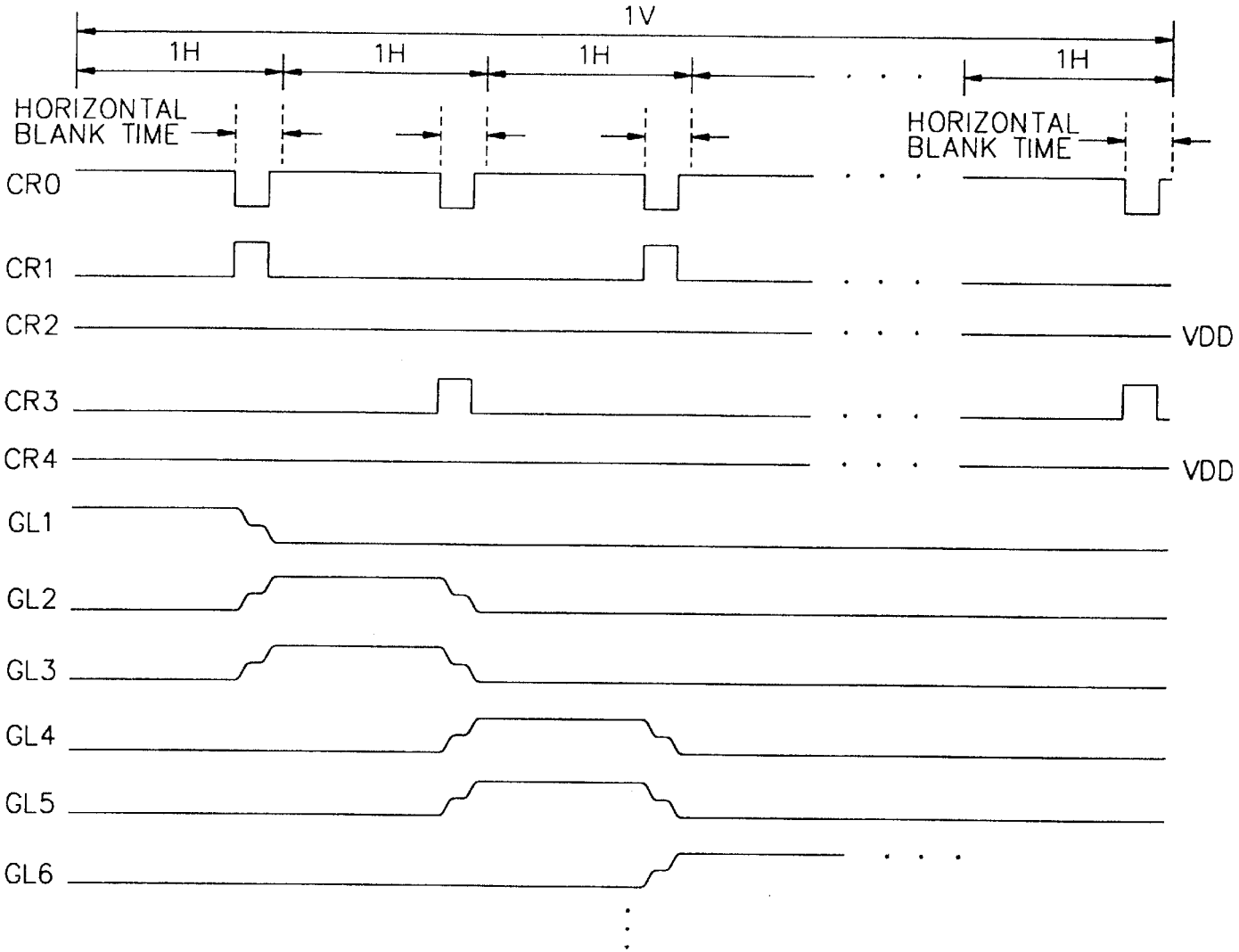
FIGS. 9A–9K are waveform diagrams of gate drivers for outputs of a control signal generator and an electric charge recycling, in an odd number field of a double line simultaneous scanning method for an A/V application.

When the first input control signal INT is 1, the control signal generator 50 outputs a control signal CR1 shown in FIG. 5B for the sequential scanning method during the horizontal blank time regardless of the value of the second input control signal FLD, thereby turning on a switch S2W1 of the second switching unit 60. As a result, as shown in FIGS. 6F and 6G, and FIG. 7, the electric charge stored in the first gate line GL1 is discharged to a capacitor of a second gate line GL2, thus a level of the capacitor C of the second gate line GL2 thereof is raised up to a VDD/2 level by recycling the electric charge without receiving any electric charge from an external source (a buffer of the gate driver).

When two switches S2W1 and S2W2 of the second switching unit 60 are simultaneously turned on after the second gate line GL2 is driven (charged), the electric charge charged in the capacitor of the second gate line GL2 is transferred to a capacitor of a third gate line GL3 as well as to the capacitor of the first gate line GL1. As shown in FIGS. 6B to 6E, the control signals CR1 and CR3 of odd number switches S2W1 and S2W3 of the second switching unit 60, and control signals CR2 and CR4 of even number switches S2W2 and S2W4 thereof are alternatively supplied thereto by every 2H (here, H is a horizontal scanning cycle). In addition, the switches S1W1, . . . ,S1Wn of the first switching unit 40 should be turned off in accordance with the control signal CR0 while the electric charge is being transferred between the gate lines GLn during the horizontal blank time.

Figure 11:
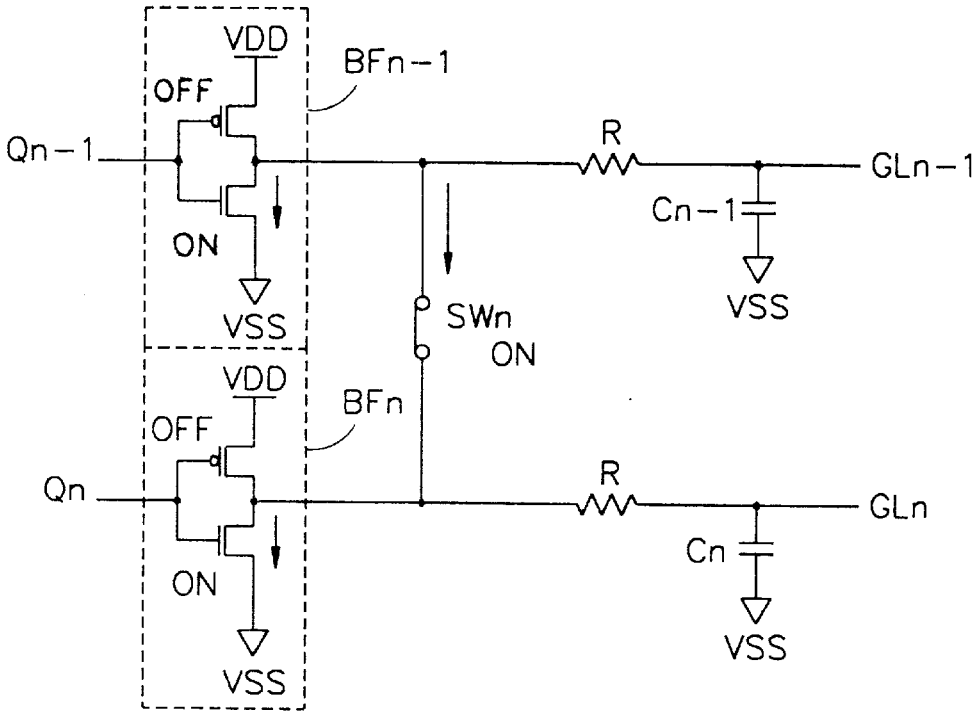
FIG. 11 is a diagram illustrating the operation of a switching unit of FIG. 3.

If the switches S1W1, . . . ,S1Wn of the first switching unit 40 does not exist, or the switches SW1, . . . ,SWn thereof are in a turn-on state, for example, as shown in FIG. 11, the electric charge charged in a capacitor Cn−1 of a gate line GLn−1 is all discharged through a pull-down transistor which is turned on in a buffer BFn of the gate driver 30. The electric potential of a capacitor Cn in a gate line GLn can not be raised up to the VDD/2 level due to the electric charge which is transferred from the gate line GLn−1. As a result, the capacitor Cn of the gate line GLn may be charged all by the buffer BFn of the last terminal in the gate driver 30, that is, an electric charge supplied from the external source VDD.

Figure 1:
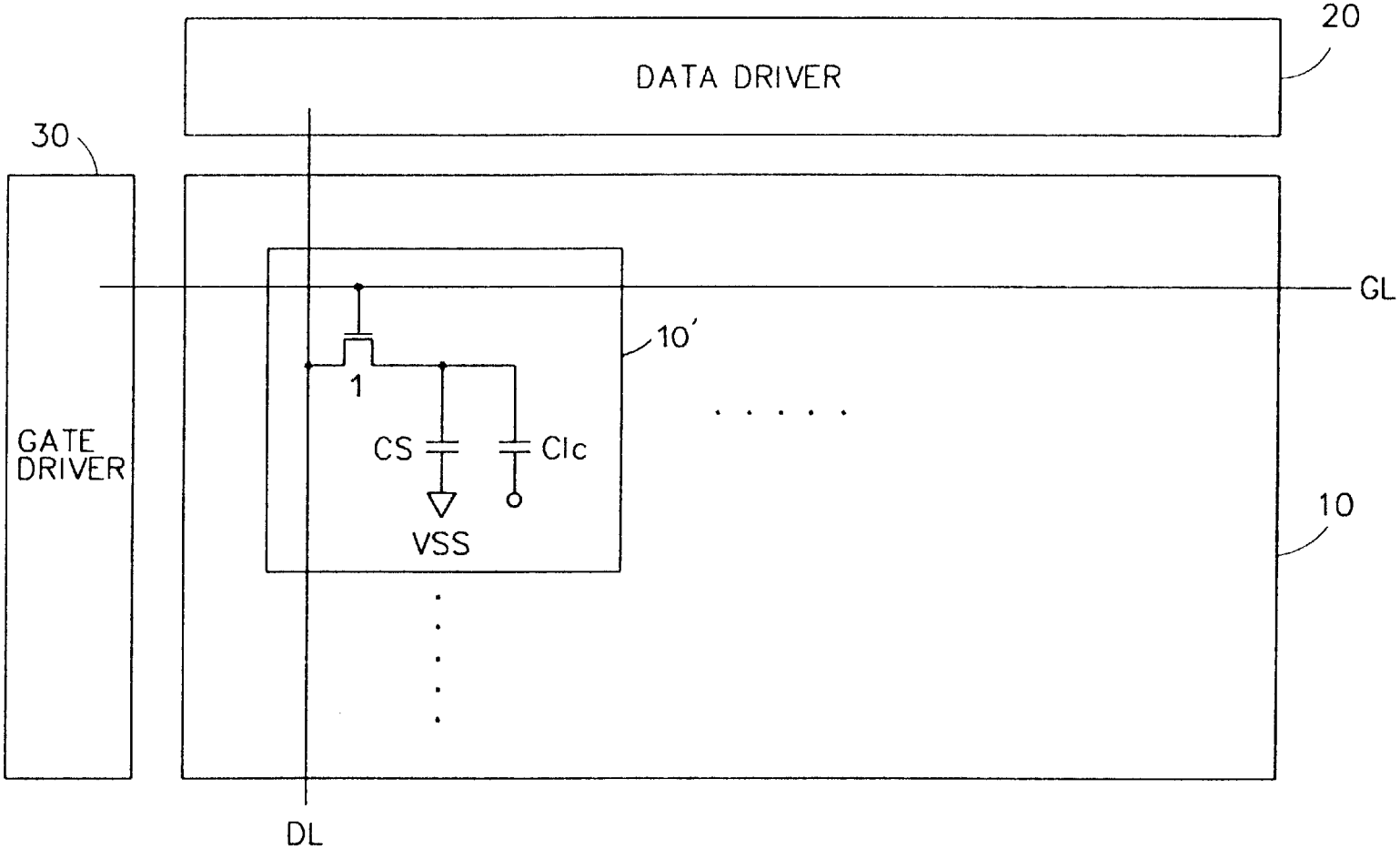
FIG. 1 CONVENTIONAL ART
FIG. 1 is a block diagram of a conventional TFT-LCD.
Figure 2A:
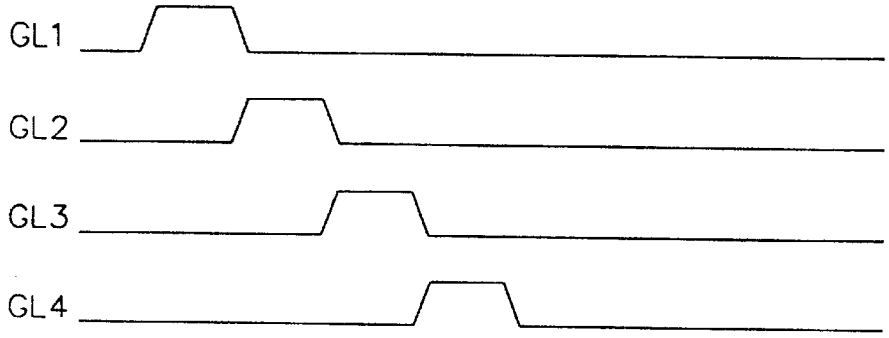
FIG.2A CONVENTIONAL ART
FIGS. 2A–2C are waveform diagrams of output signals of gate drivers of FIG. 1.
Figure 2B:
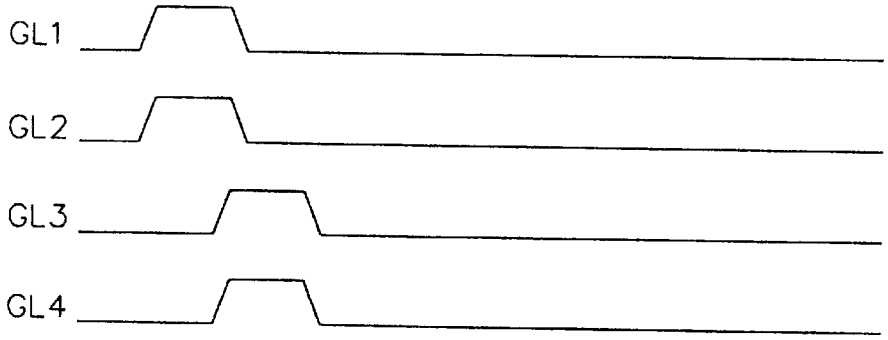
FIG.2B CONVENTIONAL ART

Next, the operation of generating the control signal for the even number field in the double line simultaneous scanning method for the A/V application will be described. First, as shown in FIG. 2B, the gate driver 30 repeats the operation of applying a turn-on signal to the first and second gate lines GL1 and GL2, and an identical signal to the third and fourth gate lines GL3 and GL4, respectively.

As shown in FIGS. 8B to 8E, when both of the first and second input control signals INT and FLD are 0, the control signal generator 50 outputs odd control signals CR(2k−1) (k=1,2,3, . . . ,n/2) at the VDD level to odd number switches S2W(2k−1) (k=1,2,3, . . . ,n/2) of the second switching unit 60 during the horizontal blank time, and alternatively applies even control signals CR(2k)(k=1,2,3, . . . ,n−2/2) of clock pulse-type to even number switches S2W(2k)(k=1,2,3, . . . ,n−2/2) of the second switching unit 60 by every 2H. As a result, recycling of the electric charges between the gate lines GL is accomplished thus, as shown in FIGS. 8F to 8K, the first and second gate lines GL1 and GL2, the third and fourth gate lines GL3 and GL4, and the fifth and sixth gate lines GL5 and GL6 have substantially identical electric potential, and the electric charge recycling is accomplished between gate lines GL2n and gate lines GL2n+1.

Figure 2C:
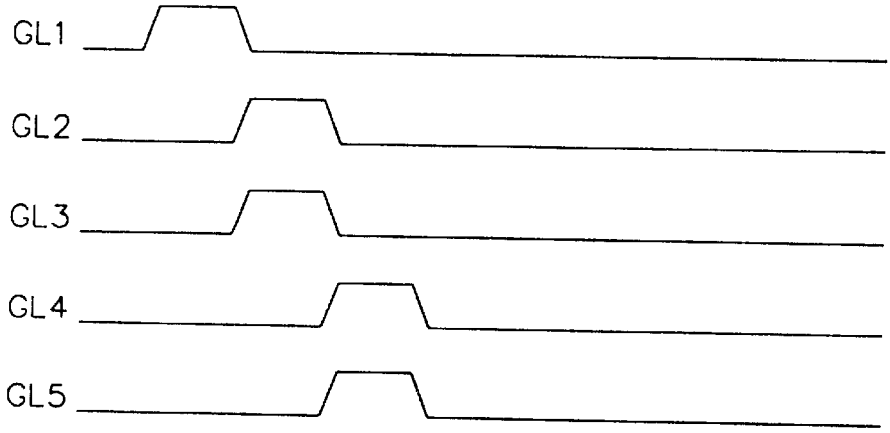
FIG.2C CONVENTIONAL ART

Now, the operation of generating the control signal for the odd number field in the double line simultaneous scanning method for the A/V application will be described. As shown in FIG. 2C, the gate driver 30 repeats the operation of applying a turn-on signal to the first gate line GL1, an identical signal to the second and third gate lines GL2 and GL3, respectively, and an identical signal to the fourth and fifth gate lines GL4 and GL5, respectively.

As shown in FIGS. 9B to 9E, when the first input control signal INT is 0 and the second input control signal FLD is 1, the control signal generator 50 turns on even number switches S2W(2k)(k=1,2,3, . . . ,n−2/2) of the second switching unit 60 by applying even control signals CR(2k) (k=1,2,3, . . . ,n−2/2) of a clock pulse-type at the VDD level, and alternatively applies odd control signals CR(2k−1)(k=1,2,3, . . . ,n/2) to odd number switches S2W(2k−1)(k=1,2,3, . . . ,n/2) of the second switching unit 60 every 2H during the horizontal blank time. As shown in FIGS. 9F to 9K, the second and third gate lines GL2 and GL3, and the fourth and fifth gate lines GL4 and GL5 have substantially identical electric potential, and the electric charge recycling is accomplished between gate lines GL2n−1 and gate lines GL2n.

Accordingly, while the output signal from the gate driver 30 swings from VDD to VSS in the conventional driver circuit of the TFT-LCD, the output signal from the gate driver 30 according to the present invention swings from VSS to VDD/2, and again swings from VDD/2 to VDD. Here, an power $P_2$ which the gate driver 30 consumes is same as the following formula (2).

$$P_2=VDD\cdot(C_n\cdot V_{swing}/2\cdot\text{Frame frequency})=P_1/2 \quad (2),$$

where

Cn is a capacitor of a nth gate line GLn. Accordingly, the power $P_2$ which the gate driver 30 according to the preferred embodiment of the present invention is decreased by ½ of the power $P_1$ of the conventional gate driver.

Figure 12:
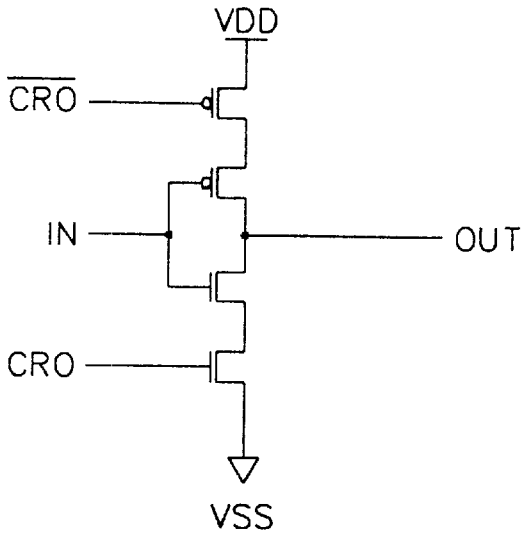
FIG. 12 is a circuit diagram of a tri-state buffer which can be substituted for a plurality of switches of the first switching unit and buffers of the gate driver in FIG. 3.

Also, each of the switches S1W1–S1Wn of the first switching unit 40 and buffers BFn in the gate driver 30 can be substituted for a tri-state buffer shown in FIG. 12. The plurality of switches S2W1–S2Wn−1 of the second switching unit 60 can be substituted for a plurality of transmitting gates or pass-transistors.

As described above, the TFT-LCD driver circuit according to a preferred embodiment of the present invention recycles the electric charges between the gate lines by controlling the switches, each connected between the gate lines, during the horizontal blank time, thus being applicable to the sequential scanning method and double line simultaneous scanning method. The circuit according to a preferred embodiment of the present invention reduces the power which the gate driver consumes by ½ of that which the conventional gate driver consumes by controlling the transmitting gate which is connected between the gate lines during the horizontal blank time. In addition, the gate driver according to a preferred embodiment of the present invention is capable of reducing its power consumption and therefore less heat is generated, which prevents the properties of the liquid crystal and TFT fabricated of poly-silicon thin film transistor (Poly-Si TFT) from being deteriorated due to the heat.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A display device comprising:

a plurality of data lines in a first direction;

a plurality of gate lines in a second direction;

a display unit having a plurality of pixels, each pixel coupled to a corresponding data line and a corresponding gate line;

a switching device coupled to said plurality of gate lines;

a control signal generator coupled to said switching device;

a first driver coupled to said plurality of data lines; and a second driver coupled to said switching device, wherein said switching device disconnects said plurality of gate lines for a prescribed period of time to allow transfer of charges between corresponding gate lines, wherein said switching device includes:

a first switching unit responsive to a first control signal from said control signal generator for disconnecting said plurality of gate lines during the prescribed period of time, said first switching unit having a plurality of first switches coupled to said second driver and said plurality of first switches being responsive to the first control signal, and a second switching unit responsive to a plurality of second control signals from said control signal generator to allow transfer of charges between corresponding gate lines, said second switching unit having a plurality of second switches, each of said plurality of second switches being coupled between adjacent gate lines and being responsive to a corresponding second control signal.

2. The display device of claim 1, wherein said display unit is a liquid crystal display panel.

3. The display device of claim 2, wherein each pixel comprises a transistor having first and second electrodes and a control electrode, a first capacitor and a second capacitor, said first and second capacitors being coupled to the second electrode.

4. The display device of claim 3, wherein said first driving circuit is a data driving unit a corresponding data line being coupled to the first electrode of a corresponding transistor of the pixel.

5. The display device of claim 4, wherein said second driving circuit is a gate driving unit a corresponding gate line being coupled to the control electrode of the corresponding transistor of the pixel.

6. The display device of claim 1, wherein the prescribed period of time occurs during horizontal blank times.

7. The display device of claim 1, wherein said first switching unit includes a plurality of first switches coupled to said plurality of buffers and responsive to said first control signal, and said second switching unit includes a plurality of second switches coupled to said plurality of plurality of second switches and said plurality of second signal lines, each of said plurality of second switches being coupled between adjacent second signal lines and being responsive to a correspond second control signal.

8. The display device of claim 1, wherein said second driver comprises:

a shift register having a plurality of output terminals; and a plurality of buffers coupled to said plurality of output terminals and said plurality of first switches.

9. The display device of claim 1, wherein said plurality of first switches is a plurality of tri-state buffers.

10. The display device of claim 1, wherein said control signal generator comprises:

a plurality of first multiplexers coupled for receiving externally applied control signals and responsive a first input control signal;

a plurality of second multiplexers, each coupled for receiving a corresponding externally applied control signal and responsive to a second input control signal to output a corresponding second control signal.

11. The display device of claim 10, wherein said first input control is indicative of first and second mode of operations, and second input control signal is indicative of first and second operation of the second mode.

12. The display device of claim 11, wherein said first mode of operation is indicative of office automation application and said second mode of operation is indicative of audio/video application.

13. The display device of claim 12, wherein said first operation is an even number field for a double line simultaneous scanning method, and said second operation is an odd number field for the double line simultaneous scanning method.

* * * * *